US009441563B2

(12) United States Patent
Kobayashi et al.

(10) Patent No.: US 9,441,563 B2
(45) Date of Patent: Sep. 13, 2016

(54) VEHICLE CONTROL DEVICE

(71) Applicant: AISIN SEIKI KABUSHIKI KAISHA, Kariya-shi, Aichi (JP)

(72) Inventors: Masaki Kobayashi, Okazaki (JP); Yoshiaki Yamakawa, Toyota (JP); Kazuo Ueda, Gamagori (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 0 days.

(21) Appl. No.: 14/772,421

(22) PCT Filed: Mar. 5, 2015

(86) PCT No.: PCT/JP2015/056469

§ 371 (c)(1),
(2) Date: Sep. 3, 2015

(87) PCT Pub. No.: WO2015/137225

PCT Pub. Date: Sep. 17, 2015

(65) Prior Publication Data

US 2016/0108840 A1 Apr. 21, 2016

(30) Foreign Application Priority Data

Mar. 14, 2014 (JP) ..... 2014-051317

(51) Int. Cl.
*F01L 1/34* (2006.01)
*F02D 41/06* (2006.01)
(Continued)

(52) U.S. Cl.
CPC ..... *F02D 41/062* (2013.01); *F01L 1/047* (2013.01); *F01L 1/344* (2013.01); *F01L 1/3442* (2013.01);
(Continued)

(58) Field of Classification Search
CPC .. F02D 41/062; F02D 41/26; F02D 41/0225; F01L 1/344; F01L 1/047; F02N 11/0803
USPC ..... 123/90.17
See application file for complete search history.

(56) References Cited

U.S. PATENT DOCUMENTS

2013/0118428 A1* 5/2013 Suzuki ..... F02D 13/0215 123/90.15
2013/0319357 A1 12/2013 Suzuki et al.
2014/0069360 A1 3/2014 Kobayashi et al.

FOREIGN PATENT DOCUMENTS

JP 2013-249750 A 12/2013
JP 2014-062486 A 4/2014

OTHER PUBLICATIONS

Partial English Translation of International Search Report (Form PCT/ISA/210) issued on Jun. 2, 2015, by the Japanese Patent Office in corresponding International Application No. PCT/JP2015/056469. (1 page).

(Continued)

*Primary Examiner* — Zelalem Eshete
(74) *Attorney, Agent, or Firm* — Buchanan Ingersoll & Rooney PC

(57) ABSTRACT

A control device is configured that can shorten the time required for a system to stop due to an ignition switch operation in a situation in which the internal combustion engine is stopped due to stop control. The control device includes a control unit that, in the situation in which the internal combustion engine is stopped due to stop control, if the transmission mechanism is operated to a second shift position that is different from a first shift position in which the vehicle can travel, executes phase conversion control to shift a valve opening/closing timing control mechanism from a first lock phase to a second lock phase.

6 Claims, 9 Drawing Sheets

(51) Int. Cl.

| | |
|---|---|
| ***F01L 1/047*** | (2006.01) |
| ***F01L 1/344*** | (2006.01) |
| ***F02D 41/02*** | (2006.01) |
| ***F02D 41/26*** | (2006.01) |
| ***F02N 11/08*** | (2006.01) |
| *F02D 13/02* | (2006.01) |

(52) U.S. Cl.
CPC ..... *F02D 41/0225* (2013.01); *F02D 41/26* (2013.01); *F02N 11/0803* (2013.01); *F01L 2001/34463* (2013.01); *F01L 2800/03* (2013.01); *F02D 13/02* (2013.01)

(56) References Cited

OTHER PUBLICATIONS

International Search Report (PCT/ISA/210) mailed on Jun. 2, 2015, by the Japanese Patent Office as the International Searching Authority for International Application No. PCT/JP2015/056469.

Written Opinion (PCT/ISA/237) mailed on Jun. 2, 2015, by the Japanese Patent Office as the International Searching Authority for International Application No. PCT/JP2015/056469.

* cited by examiner

VEHICLE CONTROL DEVICE

TECHNICAL FIELD

The present invention relates to an improvement for a vehicle control device that has a motor that starts up an internal combustion engine, a valve opening/closing timing control mechanism that sets the opening/closing timing of the internal combustion engine, and a control unit that realizes stop control for stopping the internal combustion engine.

BACKGROUND ART

As a vehicle control device configured as described above, PTL 1 discloses a configuration in which the opening/closing timing of an intake valve is set by setting the rotation phase of a valve opening/closing timing control mechanism that is provided on the same axis as the intake camshaft of the internal combustion engine.

In PTL 1, when the vehicle has been stopped by pressing the brake pedal, start-stop control is performed for stopping the internal combustion engine after the relative rotation phase of the valve opening/closing timing control mechanism has been locked at the maximum retard lock phase. Also, in the case where the engine has been stopped due to an ignition switch operation, normal stop control is performed for stopping the engine after shifting the relative rotation phase of the valve opening/closing timing control mechanism from the maximum retard phase to a first intermediate lock phase and locking it there.

CITATION LIST

Patent Literature

PTL 1: JP 2013-249750A

SUMMARY OF INVENTION

Technical Problem

In the start-stop control disclosed in PTL 1, the relative rotation phase of the valve opening/closing timing control mechanism is locked at the maximum retard phase, and then the internal combustion engine is stopped. If the internal combustion engine is started up again in this state, the compression ratio of the internal combustion engine is low, and smooth startup is realized by performing cranking with a light load. Start-stop control prevents wasteful consumption of fuel, and therefore is a technique used in hybrid vehicles as well.

Also, in normal stop control, the internal combustion engine is stopped after locking the relative rotation phase of the valve opening/closing timing control mechanism at an intermediate lock phase. When performing startup again in the intermediate lock phase, the compression ratio of the internal combustion engine is set appropriately high, and therefore the internal combustion engine can be started up favorably even in a low temperature state.

In the control mode shown in PTL 1, if the ignition switch has been switched off, the relative rotation phase of the valve opening/closing timing control mechanism shifts to an intermediate phase after this operation, and the internal combustion engine stops after the locked state has been reached.

However, in a configuration in which a pump driven by drive force from the internal combustion engine is provided, and the relative rotation phase of the valve opening/closing timing control mechanism is controlled by fluid supplied from this pump, it is conceivable for faults such as the following to occur. Specifically, when an operation for stopping the internal combustion engine is performed using the ignition switch, if the internal combustion engine has already been stopped due to start-stop control or the like, control needs to be performed to start up the internal combustion engine in order to obtain fluid pressure. Furthermore, control needs to be performed to move the relative rotation phase toward the intermediate lock phase, and thereafter shift to the locked state and stop the internal combustion engine. Time is therefore required to complete this control, and there is room for improvement.

An object of the present invention is to configure a vehicle control device that can shorten the time required to stop the system in the case where the ignition switch is switched off in a situation in which the internal combustion engine is stopped due to stop control.

Solution to Problem

A feature of the present invention is the inclusion of an internal combustion engine provided in a vehicle; a transmission mechanism that changes drive force from the internal combustion engine and transmits the changed drive force to a travel drive system; an electric motor that starts up the internal combustion engine; a valve opening/closing timing control mechanism having a driving rotating body that rotates synchronously with a crankshaft of the internal combustion engine and a driven rotating body that is arranged on the same axis as the driving rotating body and rotates integrally with a valve opening/closing camshaft of the internal combustion engine, and having a lock mechanism that selectively holds a relative rotation phase of the driving rotating body and the driven rotating body at a first lock phase and a second lock phase that is different from the first lock phase; a control valve mechanism that controls the relative rotation phase in accordance with supply/discharge of a fluid to/from an advancing chamber and a retarding chamber formed between the driving rotating body and the driven rotating body, and that selectively performs holding and canceling of a locked state in accordance with supply/discharge of fluid to/from the lock mechanism; and a control unit that, in a case where the vehicle is stopped in a state where the transmission mechanism is set to a first shift position in which the vehicle can travel, performs stop control to hold the lock mechanism at the first lock phase and stop the internal combustion engine, and, in a case where the transmission mechanism is switched to the second shift position that is different from the first shift position in a situation where the internal combustion engine is stopped based on the stop control, controls the motor to start up the internal combustion engine and executes phase conversion control in which the lock mechanism shifts from the first lock phase to the second lock phase.

It can be thought that the first lock phase is set to, for example, a phase that mitigates load at the time of starting up again, and the second lock phase is set to a phase at which the internal combustion engine is favorably started up at a low temperature. In the case of performing setting in this way, in stop control, by holding the relative rotation phase at the first lock phase using the lock mechanism, it is possible to smoothly start up the internal combustion engine. Also, in the case where the driver parks in a situation in which the internal combustion engine is stopped due to this stop control, a sequence is performed in which the transmission mechanism is operated to the parking position or the neutral position, and thereafter the ignition switch is switched off. For this reason, if the shift position of the transmission mechanism is changed from the first shift position to the second shift position in the situation in which the internal combustion engine is stopped due to stop control, by changing the relative rotation phase from the first lock phase to the second lock phase, the system can be swiftly stopped if the ignition switch is switched off thereafter.

Accordingly, a vehicle control device is configured in which it is possible to shorten the time required to stop the system in the case where the ignition switch is switched off in a situation in which the internal combustion engine is stopped due to stop control.

In the present invention, the valve opening/closing timing control mechanism may be provided on an intake camshaft that serves as the camshaft, the first lock phase may be set at a maximum retard phase at which an intake valve opening/closing timing is most delayed, and the second lock phase may be set to an intermediate lock phase at which the intake valve opening/closing timing is earlier than the maximum retard phase.

According to this configuration, due to the relative rotation phase of the valve opening/closing timing control mechanism being set to the maximum retard phase as the first lock phase, it is possible to lower the load at the time of startup of the internal combustion engine, raise the rotational speed of the crankshaft in a short time at the time of cranking, and shorten the time required to start up the internal combustion engine. Also, if the relative rotation phase is set to the intermediate lock phase as the second lock phase, it is possible to properly start up even if the internal combustion engine is in a low temperature state.

In the present invention, in a case where a stop operation is performed on the internal combustion engine in a process of shifting from the first lock phase to the second lock phase based on the phase conversion control, the internal combustion engine may be stopped after the control unit confirms completion of the shift to the second lock phase.

According to this configuration, envision that in the state in which the internal combustion engine is stopped due to stop control, for example, the driver operates the shift lever from the drive position to the parking position, and then performs an operation for switching off the ignition switch in a short time. Even if this envisioned operation is performed, it is possible to stop the internal combustion engine after confirming that the lock mechanism has shifted to the second lock phase. As a result, if the internal combustion engine is started up thereafter, the internal combustion engine can start up in a situation in which the lock mechanism is locked at the second lock phase.

In the present invention, in a case where the transmission mechanism is operated such that the internal combustion engine is to stop in a process of shifting from the first lock phase to the second lock phase based on the phase conversion control, the internal combustion engine may be stopped after a set time has elapsed from when the operation was performed.

According to this configuration, envision that at the time of execution of stop control, for example, the driver operates the shift lever from the drive position to the parking position, and then performs an operation for switching off the ignition switch in a short time. Even if this envisioned operation is performed, the internal combustion engine is stopped after a set time period has elapsed from when the off operation was performed, and therefore by setting the set time period to a time period sufficient for shifting to the second lock phase, it is possible to stop the internal combustion engine after shifting the lock mechanism to the second lock phase. As a result, if the internal combustion engine is started up thereafter, the internal combustion engine can start up in a situation in which the lock mechanism is locked at the second lock phase.

In the present invention, control in which the internal combustion engine may be started up based on the phase conversion control may continue until a shift to a state in which the crankshaft starts to rotate due to combustion of fuel supplied to the internal combustion engine.

According to this configuration, at the time of startup of the internal combustion engine, there is a shift to a state in which the internal combustion engine can start rotation due to the combustion of fuel. Accordingly, it is possible to obtain fluid with a high pressure from a pump driven by drive force from the internal combustion engine, and reliably perform a shift to the second lock phase.

In the present invention, the motor may be a motor for traveling.

According to this configuration, it is possible to also start up the internal combustion engine with the motor for traveling that transmits drive force to the travel drive system as with a hybrid vehicle. Accordingly, there is no need for a dedicated motor for starting up the internal combustion engine.

BRIEF DESCRIPTION OF DRAWINGS

FIG. 7 is a timing chart showing a control sequence for a phase control valve, a lock control valve, and the like.

DESCRIPTION OF EMBODIMENTS

Hereinafter, embodiments of the present invention will be described based on the drawings.

[Basic Configuration]

Figure 1:
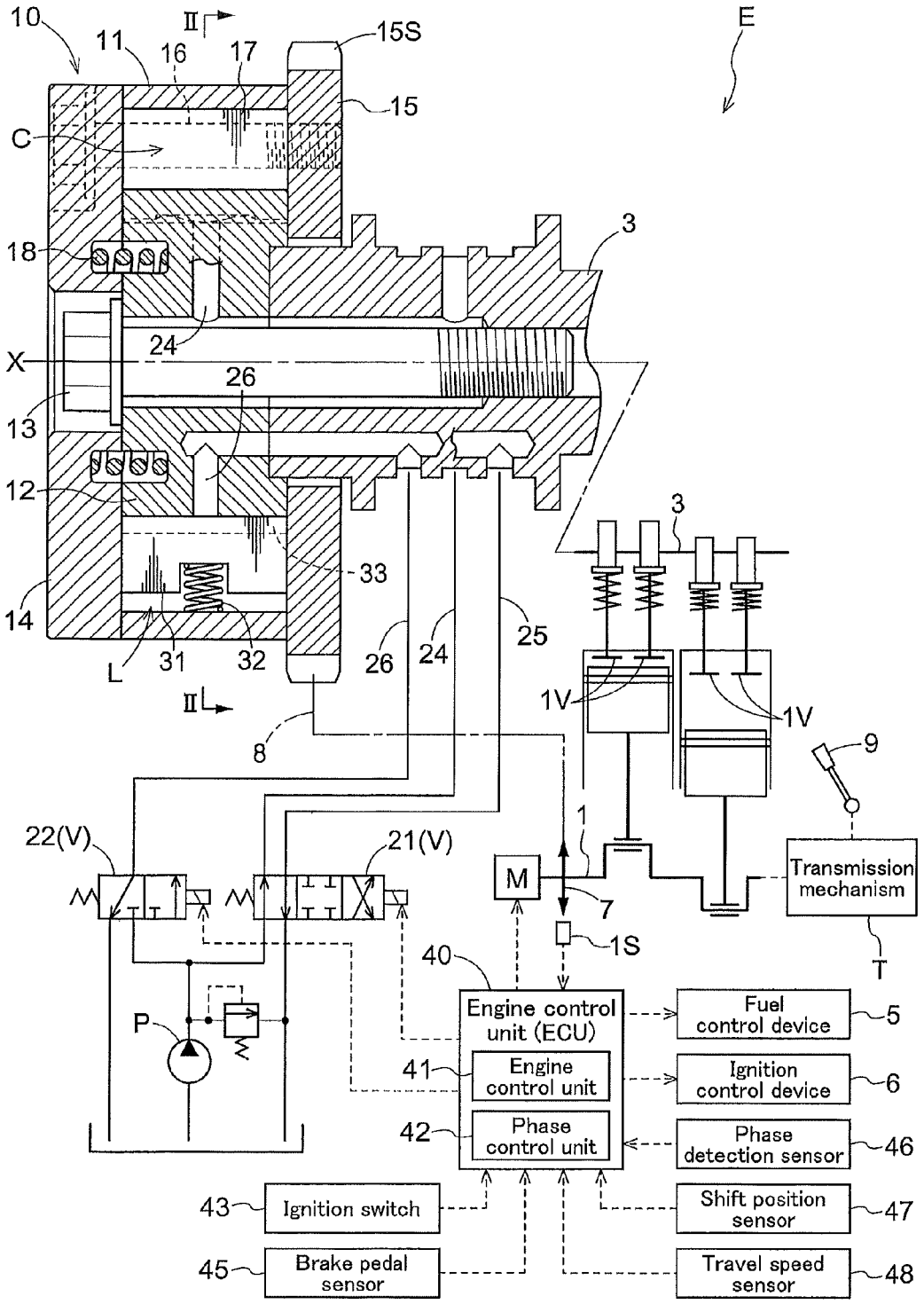
FIG. 1 is a diagram showing a configuration of a vehicle control device.

As shown in FIG. 1, a vehicle is configured such that drive force of an engine E, which is an internal combustion engine, is transmitted from a transmission mechanism T to a travel drive system. In this vehicle, the vehicle control device is configured to include a starter motor M, which is an electric motor, a valve opening/closing timing control mechanism 10 provided on an intake camshaft 3, and a control valve mechanism V that controls the valve opening/closing timing control mechanism 10, and furthermore include a control unit 40 (ECU) that controls the above members.

The intake camshaft 3 has a function of opening and closing an intake valve 1V of the combustion chamber, and the valve opening/closing timing control mechanism 10 functions so as to set the intake timing of the engine E by performing relative rotation phase setting.

This vehicle control device realizes start-stop control (an example of stop control) for stopping the engine E if the vehicle is stopped while waiting for a traffic light, for example, and performs control for setting the relative rotation phase of the valve opening/closing timing control mechanism 10 based on the rotational speed of the engine E, the load acting on the engine E, and the like.

[Engine, Transmission, Starter Motor]

The engine E is a 4-cycle type of engine provided in a vehicle such as a passenger automobile. This engine E includes an injector that supplies fuel to an intake port or a combustion chamber, and includes a spark plug that ignites an air-fuel mixture in the combustion chamber. The injector is controlled by a fuel control device 5, and the spark plug is controlled by an ignition control device 6. The engine E also includes a shaft sensor 1S that detects the rotation angle and the rotational speed of a crankshaft 1.

A transmission mechanism T converts drive force from the crankshaft 1 of the engine E and transmits it to the travel drive system. Examples of specific configurations include a configuration having an automatic transmission mechanism and a torque converter that create multiple gear ranges using hydraulic pressure control, and a configuration having a belt variable transmission mechanism and an electromagnetic clutch that perform stepless conversion using a belt CVT. Also, the transmission mechanism T includes a shift lever 9, and the shift lever 9 is configured to be able to be set to at least three types of shift positions, including traveling positions (e.g., a drive position and a reverse position), a neutral position, and a parking position. A starter motor M is configured to transmit drive force to the crankshaft 1 when undergoing drive rotation.

[Valve Opening/Closing Timing Control Mechanism]

Figure 2:
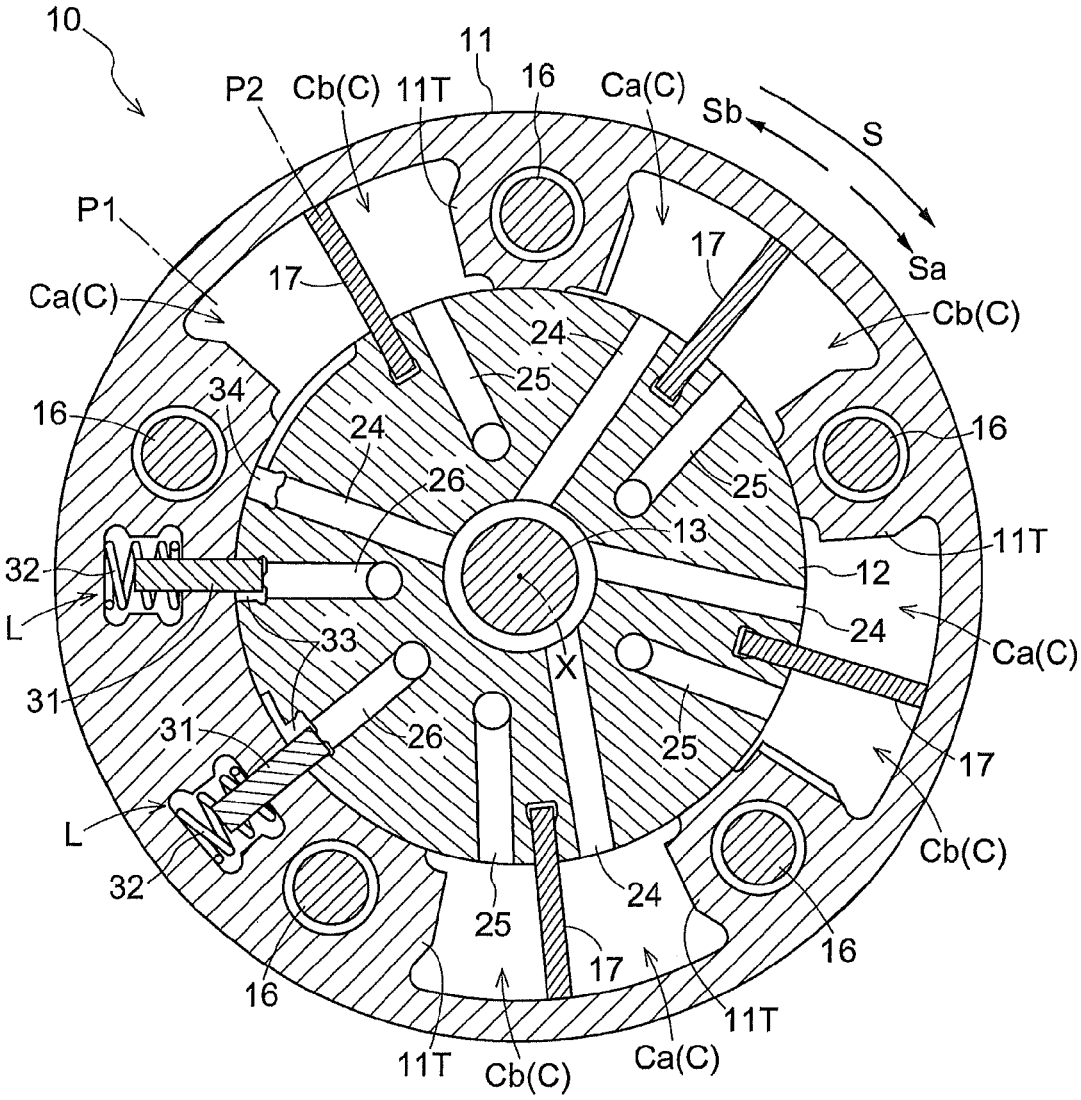
FIG. 2 is a cross-sectional diagram of the valve opening/closing timing control mechanism in FIG. 1, taken along line II-II.
Figure 3:
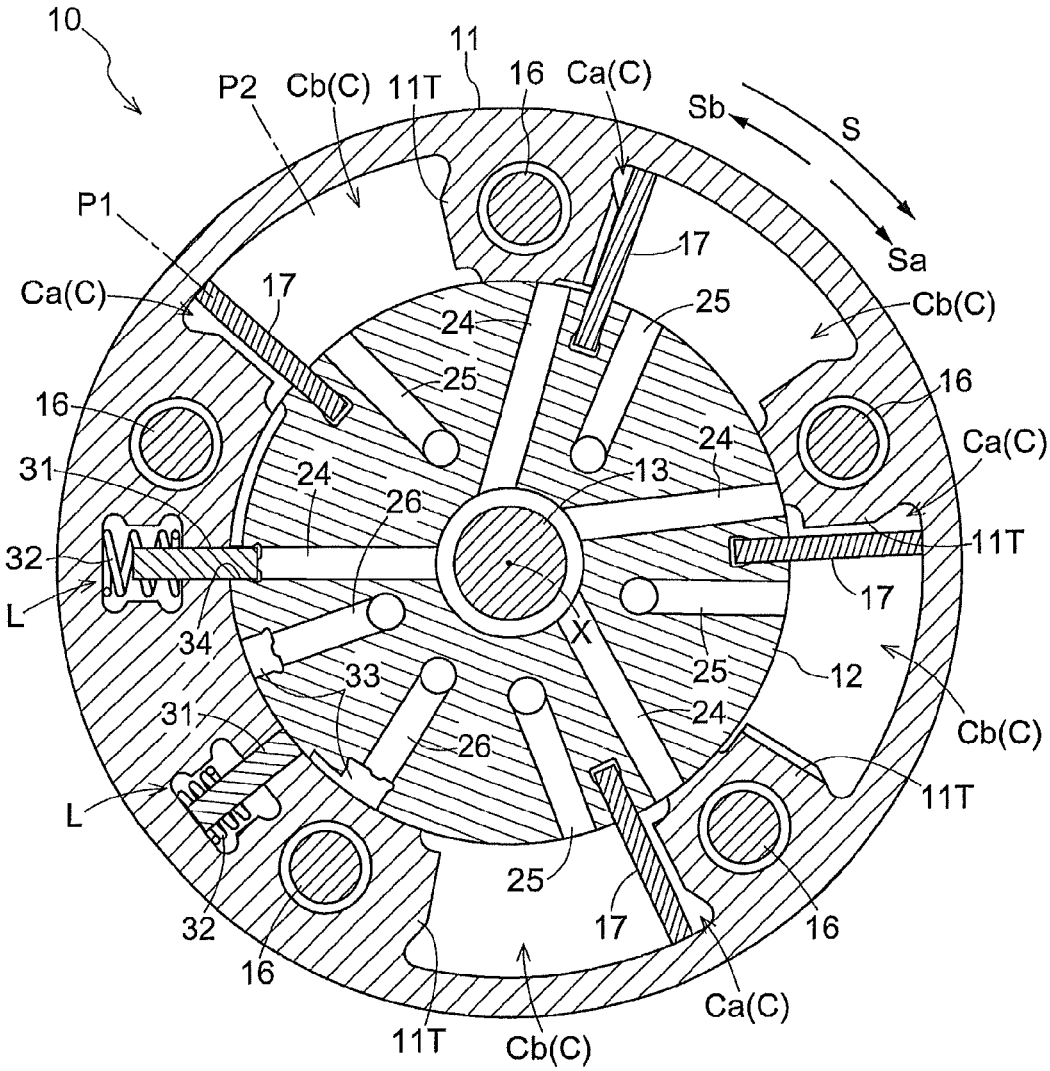
FIG. 3 is a cross-sectional diagram of the valve opening/closing timing control mechanism in the maximum retard lock phase.

As shown in FIGS. 1 to 3, the valve opening/closing timing control mechanism 10 includes an external rotor 11 as a driving rotating body that rotates synchronously with the crankshaft 1 of the engine E, and an internal rotor 12 as a driven rotating body that is coupled with an intake camshaft 3, which opens and closes an intake valve 1V of the combustion chamber of the engine E, by a coupling bolt 13. The internal rotor 12 is arranged on the same axis as a rotation axis X of the intake camshaft 3, and due to the internal rotor 12 being fitted into the external rotor 11, the two are capable of relative rotation about the rotation axis X.

A phase detection sensor 46 that detects the relative rotation phase of the external rotor 11 and the internal rotor 12 is provided outside of the valve opening/closing timing control mechanism 10.

The external rotor 11 is fastened by fastening bolts 16 in the state of being sandwiched between a front plate 14 and a rear plate 15, and the internal rotor 12 is arranged between the front plate 14 and the rear plate 15. A timing sprocket 15S is formed on the outer circumference of the rear plate 15.

Multiple protrusion portions 11T that protrude inward in the radial direction are formed integrally with the external rotor 11. The internal rotor 12 is formed in the shape of a cylinder having an outer circumference in close contact with the protruding edges of the protrusion portions 11T. Accordingly, multiple fluid pressure chambers C are formed on the outer circumferential side of the internal rotor 12 at positions between protrusion portions 11T that are adjacent in the rotation direction. Multiple vanes 17 are provided on the outer circumference of the internal rotor 12 as partition portions that are attached so as to protrude toward the fluid pressure chambers C. Each fluid pressure chamber C is partitioned by a vane 17 such that an advancing chamber Ca and a retarding chamber Cb are formed. The vane 17 is biased by a spring or the like in the direction away from the rotation axis X, and thus the protruding edge comes into contact with the inner circumferential face of the fluid pressure chamber C.

A torsion spring 18, which applies biasing force until the relative rotation phase of the external rotor 11 and the internal rotor 12 (hereinafter called the relative rotation phase) moves from the maximum retard phase to an intermediate lock phase P2, is provided so as to span the internal rotor 12 and the front plate 14.

In this valve opening/closing timing control mechanism 10, a timing chain 8 is wrapped around an output sprocket 7, which is provided on the crankshaft 1 of the engine E, and the timing sprocket 15S, and thus the external rotor 11 rotates synchronously with the crankshaft 1. Although not illustrated, a device with a configuration similar to the valve opening/closing timing control mechanism 10 is provided on the front edge of the camshaft on the exhaust side as well, and rotation force from the timing chain 8 is transmitted to this device as well.

As shown in FIGS. 2 and 3, in the valve opening/closing timing control mechanism 10, the external rotor 11 rotates toward the drive rotation direction S due to drive force from the crankshaft 1. The direction in which the internal rotor 12 rotates in the same direction as the drive rotation direction S relative to the external rotor 11 is called an advance direction Sa, and the rotation direction toward the opposite direction is called a retard direction Sb.

Out of the portions of the fluid pressure chamber C partitioned by the vane 17, the space in which the relative rotation phase is displaced in the advance direction Sa due to the supply of hydraulic oil is the advancing chamber Ca, and conversely, the space in which the relative rotation phase is displaced in the retard direction Sb due to the supply of hydraulic oil is the retarding chamber Cb. The relative rotation phase at which the vane 17 has reached the operation end in the advance direction Sa (including the phase in the vicinity of the operation end in the advance direction Sa of the vane 17) is called the maximum advance phase, and the relative rotation phase at which the vane 17 has reached the operation end in the retard direction Sb (including the phase in the vicinity of the operation end in the retard direction Sb of the vane 17) is called the maximum retard phase.

[Valve Opening/Closing Timing Control Mechanism: Lock Mechanism]

The valve opening/closing timing control mechanism 10 includes a pair of lock mechanisms L that selectively hold the relative rotation phase of the external rotor 11 and the internal rotor 12 at one out of a maximum retard lock phase P1 (example of first lock phase) that is the maximum retard phase and an intermediate lock phase P2 (example of second lock phase) that is between the maximum advance phase and the maximum retard phase.

Each lock mechanism L includes a pair of lock members 31 that are supported to the external rotor 11 such that the protruding edge can move toward and away from the rotation axis X, and lock springs 32 that bias the lock members 31 in the protruding direction. Also, the internal rotor 12 has formed therein a maximum retard lock recessed portion 34 with which one lock member 31 engages in the maximum retard lock phase P1, and a pair of intermediate lock recessed portions 33 with which the pair of lock members 31 independently engage in the intermediate lock phase P2.

Accordingly, due to the relative rotation phase reaching the intermediate lock phase P2, as shown in FIG. 2, the pair of lock members 31 simultaneously engage with the corresponding intermediate lock recessed portions 33, and the relative rotation phase is held at the intermediate lock phase P2. Also, due to the relative rotation phase reaching the maximum retard phase, as shown in FIG. 3, one of the lock members 31 engages with the maximum retard lock recessed portion 34, and the relative rotation phase is held at the maximum retard lock phase P1.

Note that the intermediate lock phase P2 is a phase in which startup of the engine E can be performed favorably even in a situation in which the temperature of the combustion chamber of the engine E has decreased to the outside air temperature as previously described. Also, the maximum retard lock phase P1 is a phase in which cranking can be performed with a light load due to greatly reducing the intake compression ratio. Also, although the lock members 31 are configured with a plate shape, they may be configured with a rod shape, or may be configured such that the relative rotation phase is held at the intermediate lock phase P2 by a single lock member 31.

[Hydraulic Pressure Control System]

The engine E includes a hydraulic pump P that, using drive force from the crankshaft 1, draws in oil from an oil pan, and feeds it as hydraulic oil (one example of a fluid). The hydraulic pump P supplies the hydraulic oil to an electromagnetic operation-type phase control valve 21 and an electromagnetic operation-type lock control valve 22. In this embodiment, the phase control valve 21 and the lock control valve 22 are included as a control valve mechanism V, but the control valve mechanism V may be configured using a control valve that has a single spool, for example.

Also, in this vehicle control device, an advancing channel 24 that extends from the phase control valve 21 to the advancing chamber Ca of the internal rotor 12, and a retarding channel 25 that extends from the phase control valve 21 to the retarding chamber Cb are formed. This advancing channel 24 is in communication with the maximum retard lock recessed portion 34. Furthermore, an unlocking channel 26 that extends from the lock control valve 22 to the intermediate lock recessed portions 33 of the internal rotor 12 is formed.

The phase control valve 21 is configured to be able to be operated to an advance position, a neutral position, and a retard position by adjustment of power supplied to an electromagnetic solenoid thereof. At the advance position, hydraulic oil from the hydraulic pump P is supplied from the advancing channel 24 to the advancing chamber Ca, and hydraulic oil is discharged from the retarding chamber Cb so as to displace the relative rotation phase in the advance direction Sa.

Also, when the phase control valve 21 is at the neutral position, the relative rotation phase is maintained without supplying or discharging a fluid to/from either the advancing channel 24 or the retarding channel 25. At the retard position, hydraulic oil from the hydraulic pump P is supplied from the retarding channel 25 to the retarding chamber Cb, and hydraulic oil is discharged from the advancing chamber Ca so as to displace the relative rotation phase in the retard direction Sb.

The lock control valve 22 is configured to be able to be operated to a lock position and a lock release position by adjustment of power supplied to an electromagnetic solenoid thereof. In the lock position, hydraulic oil is discharged from the unlocking channel 26, movement of the lock member 31, which is at an unlocked position, toward the locked state is enabled, and the locked state of the lock member 31, which is already at the lock position, is maintained.

In contrast, at the lock release position, hydraulic oil is supplied to the unlocking channel 26 such that the lock member 31, which is in the state of being fitted into the intermediate lock recessed portion 33, separates from the intermediate lock recessed portion 33 in resistance to the biasing force of the lock spring 32, thus realizing releasing of the locked state.

[Control Unit]

The control unit 40 is configured as an ECU, and includes an engine control unit 41 and a phase control unit 42, which are configured by software. The control unit 40 receives signals from a shaft sensor 1S, an ignition switch 43, a brake pedal sensor 45, a phase detection sensor 46, a shift position sensor 47, and a travel speed sensor 48.

Also, the control unit 40 outputs control signals to the starter motor M, the fuel control device 5, and the ignition control device 6, and outputs control signals to the phase control valve 21 and the lock control valve 22.

The ignition switch 43 is configured as a switch that starts up the system for running the engine E, and upon being switched on, starts up the system such that the engine control unit 41 starts up the engine E, and upon being switched off, the engine control unit 41 stops the engine E, and the system is stopped. Also, after the ignition switch 43 is switched on, automatic stopping and automating startup of the engine E by the start-stop control (one example of stop control) are possible.

The brake pedal sensor 45 detects the pressing of the brake pedal (not shown). The phase detection sensor 46 detects the relative rotation phase of the valve opening/closing timing control mechanism 10. The shift position sensor 47 detects the shift position of the shift lever 9, and the travel speed sensor 48 detects the travel speed of the vehicle.

The engine control unit 41 realizes engine E startup control, and start-stop control for temporarily stopping the engine E in the case of stopping traveling.

Start-stop control is executed when traveling is stopped in the state in which the shift lever 9 of the transmission mechanism T is at the drive position, which is a first shift position that can be traveled in, as in the case of stopping traveling by pressing the brake pedal during driving. Due to this start-stop control, the engine E is stopped such that fuel consumption is suppressed and fuel economy is improved. Also, if the pressing of the brake pedal is canceled in a situation where the engine E is stopped due to start-stop control, engine E startup control is executed.

The phase control unit 42 controls the opening and closing timing of the intake valve 1V by the valve opening/closing timing control mechanism 10 based on information such as the rotational speed of the engine E during running of the engine E. Also, in the case where the engine E is stopped based on start-stop control, the phase control unit 42 shifts the lock mechanisms L to the locked state at the maximum retard lock phase P1. Furthermore, if the ignition switch 43 is switched off, the phase control unit 42 issues an instruction such that the lock mechanisms L are held in the locked state at the intermediate lock phase P2. These control modes will be described below.

[Control Modes]

Figure 4:
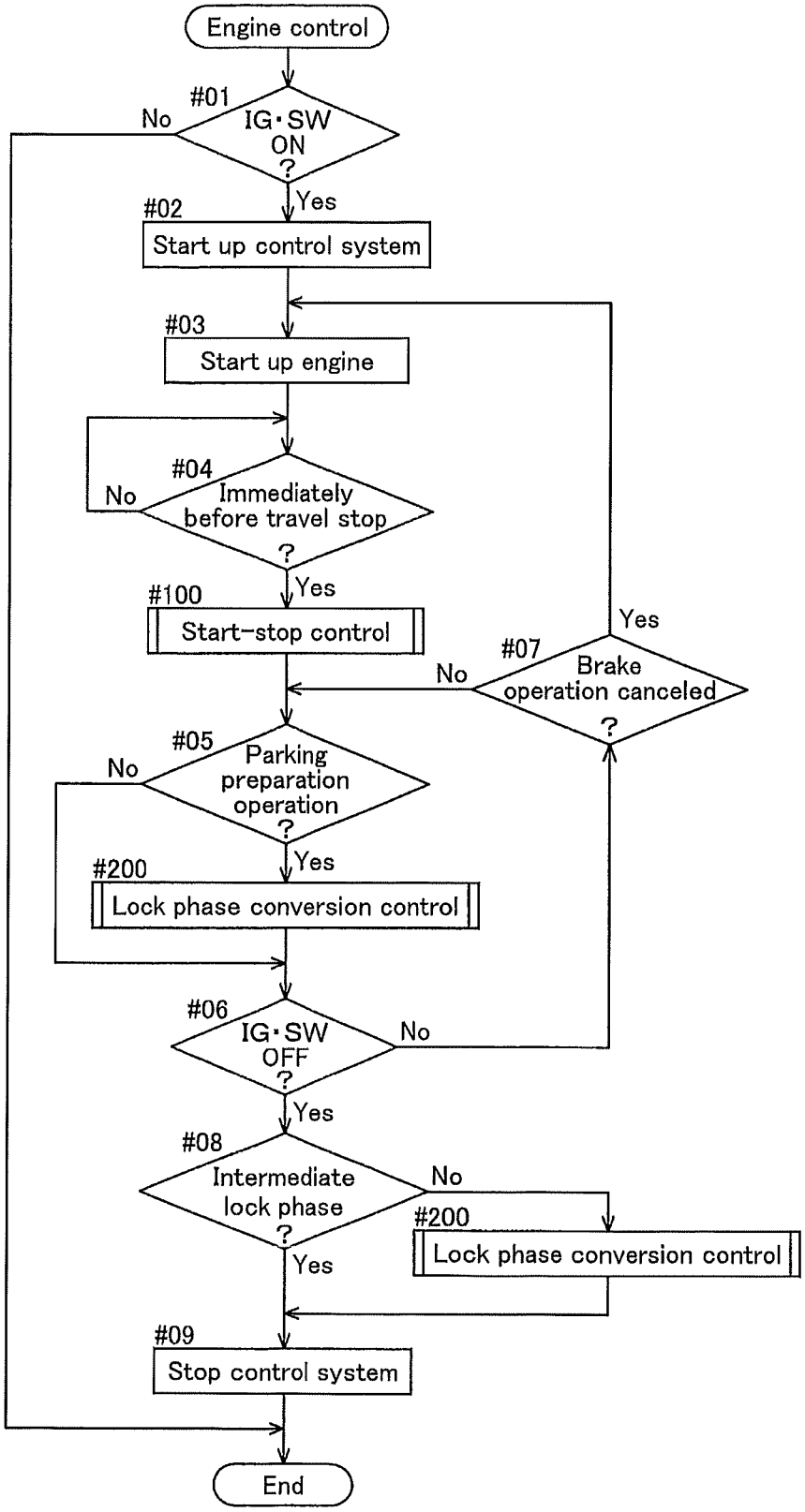
FIG. 4 is a flowchart of engine control.
Figure 7:
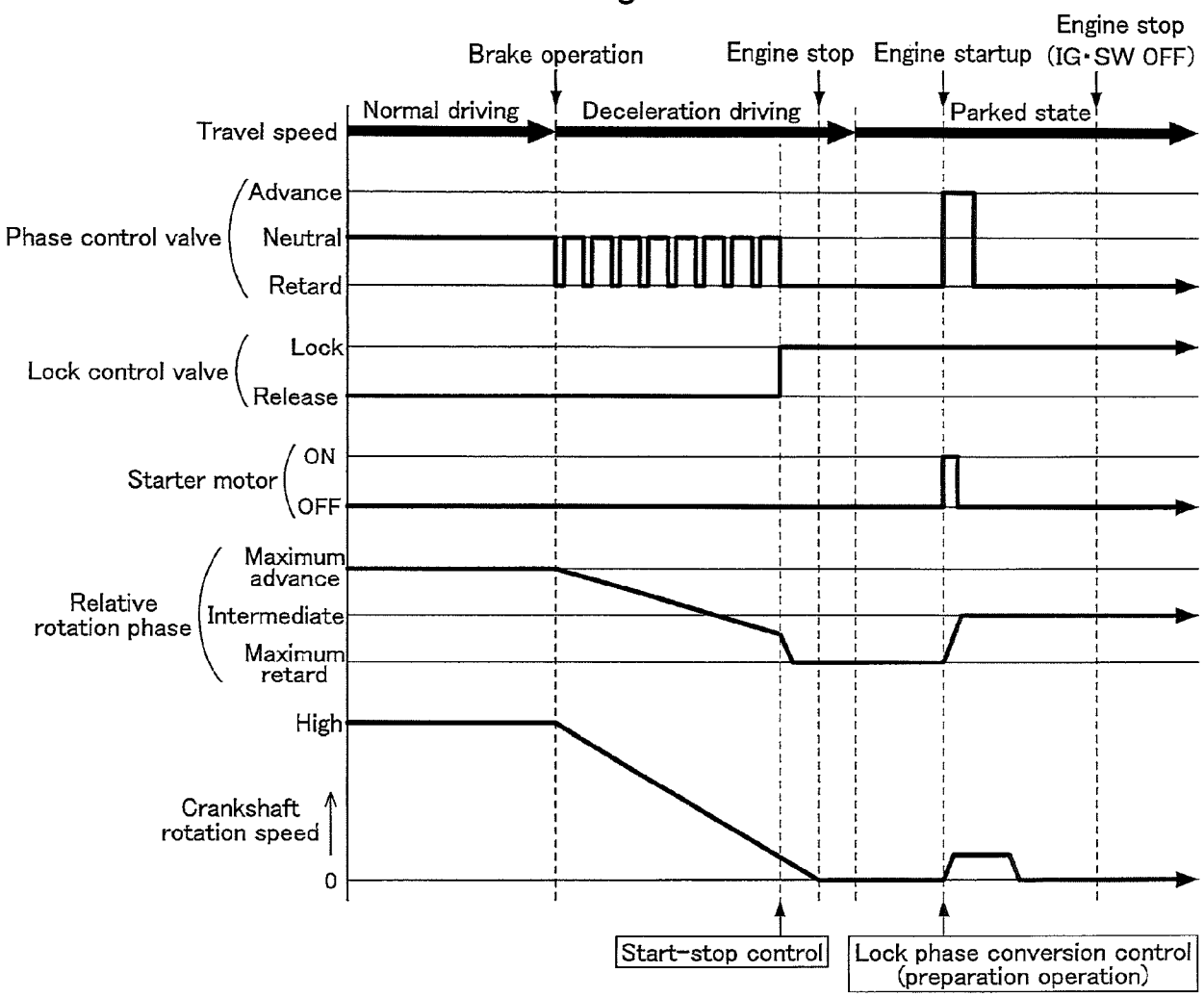

Engine control performed by the control unit 40 is shown in the flowchart in FIG. 4, and the state of the engine E and the rotation phase of the valve opening/closing timing control mechanism 10 in the engine control are shown in the timing chart in FIG. 7.

In engine control, when the ignition switch 43 (IG-SW in FIG. 4) is switched on, the engine E control system is started up, and the engine E is started up (steps #01 to #03). After this startup of the engine E, the relative rotation phase is appropriately set and controlled based on information such as the rotational speed of the engine E and the load acting on the engine E.

In this step, due to the ignition switch 43 being switched on, the engine E control system is started up, and the engine control unit 41 drives the starter motor M to perform cranking. Due to this cranking, the rotational speed of the crankshaft 1 rises to a predetermined value, and thereafter the air-fuel mixture is supplied in the combustion chamber by the fuel control device 5, and ignition is performed by the ignition control device 6, thus starting up the engine E. This is engine E startup control.

Note that startup of the engine E is shifting to a state in which rotational force is output from the crankshaft 1 due to the combustion of fuel after cranking.

Next, the driver presses the brake pedal while waiting for a traffic light or the like in the state in which the engine E is running, and there is a shift to start-stop control immediately before traveling stops (step #04, #100).

[Control Mode: Start-Stop Control]

Figure 5:
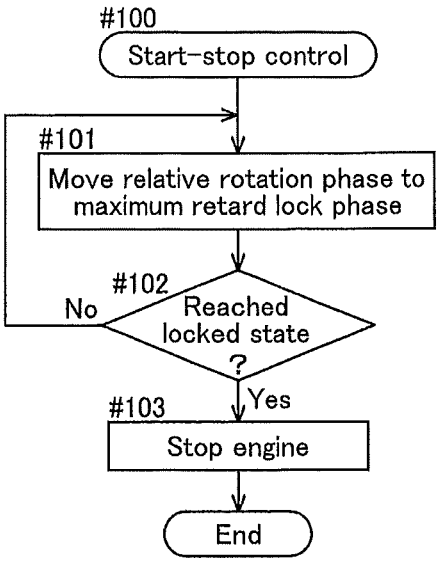
FIG. 5 is a flowchart of start-stop control.

Start-stop control (step #100) is executed in the case in which the brake pedal sensor 45 detects the pressing of the brake pedal, and the travel speed sensor 48 detects that the travel speed has decreased to a value less than a setting value. In this start-stop control, as shown in the flowchart of FIG. 5 and as shown in FIG. 7, the lock control valve 22 is operated to the lock position, and by operation of the phase control valve 21, hydraulic oil is controlled, and the relative rotation phase is moved in the retard direction Sb.

At the time of this relative rotation phase displacement, the relative rotation phase detected by the phase detection sensor 46 is fed back, and if it is determined that the relative rotation phase has reached the maximum retard lock phase P1 and been maintained at the maximum retard lock phase P1, it is determined that the lock mechanisms L are in the locked state, and the engine E is stopped (steps #101 to #103). Note that in the case of stopping the engine E, the supply of fuel by the fuel control device 5 is stopped, and ignition by the ignition control device 6 is stopped.

Note that the control start timing of this start-stop control may be set so as to be executed after traveling is fully stopped.

Next, in the state in which the engine E is stopped by the start-stop control, if a parking preparation operation has been performed, lock phase conversion control (a specific example of phase conversion control) is performed (step #05, #200).

In the present embodiment, the parking preparation operation is envisioned to be the shift lever 9 being shifted from the drive position, which is the first shift position, to the parking position as a second shift position, or a neutral position. In this embodiment, lock phase conversion control (step #200) is executed based on the shift lever 9 being set from the drive position to a position other than the drive position, based on the detection signal from the shift position sensor 47.

This parking preparation operation is an operation performed prior to an operation for stopping the engine E (prior to the switching off of the ignition switch 43). Accordingly, the operation of a parking button for creating a parking state may be the parking preparation operation.

[Control Mode: Lock Phase Conversion Control]

Figure 6:
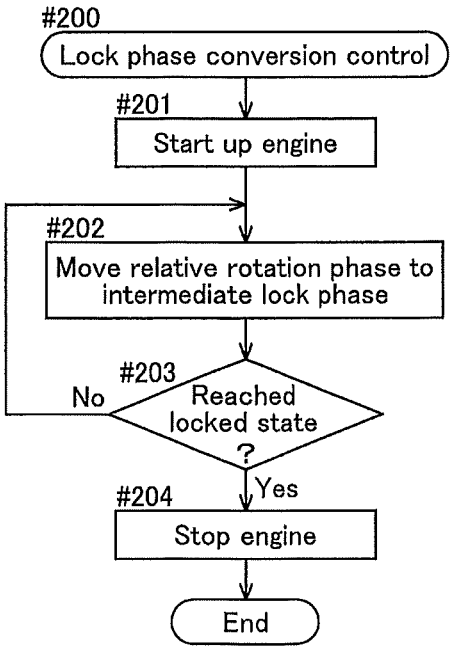
FIG. 6 is a flowchart of lock phase conversion control.

In lock phase conversion control (step #200), as shown in the flowchart of FIG. 6 and as shown in FIG. 7, the starter motor M is driven, the rotational speed of the crankshaft 1 reaches a predetermined value, and thereafter the fuel control device 5 and the ignition control device 6 are controlled to start up the engine E (step #201). After this startup, the phase control valve 21 is operated to the advance position so as to displace the relative rotation phase in the advance direction Sa. Note that startup of the engine E is the shifting to a state in which rotational force is output from the crankshaft 1 due to the combustion of fuel after cranking, as previously described.

Accordingly, hydraulic oil from the hydraulic pump P is supplied from the advancing channel 24 to the maximum retard lock recessed portion 34, and the lock member 31 in the fitted state is moved away from the maximum retard lock recessed portion 34 by hydraulic pressure of the hydraulic oil (the locked state is canceled). At the same time, hydraulic oil is supplied to the advancing chamber Ca so as to move the relative rotation phase in the advance direction Sa.

When the relative rotation phase is moved in the advance direction Sa, the relative rotation phase detected by the phase detection sensor 46 is fed back. Then, if the relative rotation phase reaches the intermediate lock phase P2, and is maintained at the intermediate lock phase P2, it is determined that the lock mechanisms L are in the locked state based on the detection result of the phase detection sensor 46, and control for stopping the engine E is performed (steps #202 to #204).

[Control Mode: Engine Startup]

Also, regardless of the execution or non-execution of control in lock phase conversion control (step #200), if the brake pedal pressing operation is canceled when the ignition switch 43 is in the on state, the engine E is started up (step #06, #07, #03).

Furthermore, if the ignition switch 43 is switched off in the state in which the engine E is stopped due to start-stop control, only in the case where the relative rotation phase is not at the intermediate lock phase P2, lock phase conversion control is executed (step #06, #08, #200), and thereafter the control system is stopped (step #09).

In other words, in the vehicle in which start-stop control is performed, the engine E has already been stopped at the time when the ignition switch 43 is switched off. Accordingly, if the shift lever 9 is shifted to the parking position in the state in which the engine E is stopped due to start-stop control, the valve opening/closing timing control mechanism 10 is held in the locked state at the intermediate lock phase P2 due to the previously described lock phase conversion control (steps #201 to #206).

In view of this, if the ignition switch 43 is switched off without operating the shift lever 9 in the state in which the engine E is stopped due to start-stop control, the relative rotation phase of the valve opening/closing timing control mechanism 10 is at the maximum retard lock phase P1, and therefore lock phase conversion control (step #200) is executed. After this control is executed, the supply of power to the control system is stopped.

EFFECTS OF EMBODIMENT

In start-stop control, the engine E is stopped in the state in which the lock mechanisms L are held in the locked state at the maximum retard lock phase P1. This maximum retard lock phase P1 is a phase at which cranking can be performed with a light load, and is a phase optimal for starting up the engine E again in a heated state.

In this way, when the engine E is to be stopped based on start-stop control, if the driver first operates the shift lever 9 to the parking position or the like in order to park, the engine E is started up, and then the relative rotation phase of the valve opening/closing timing control mechanism 10 is moved to the intermediate lock phase P2, and the lock mechanisms L are held in the locked state. Accordingly, it is possible to shorten the period of time required to stop the system after the ignition switch 43 is switched off.

ALTERNATIVE EMBODIMENTS

Besides the embodiment described above, the present invention may be carried out as described below.

(a) The present invention is applied to a hybrid vehicle that includes a travel motor, as an electric motor, that causes the vehicle to travel, and a battery that supplies power to the travel motor. It is envisioned that the engine E is started up using drive force from the travel motor in this hybrid vehicle, and the configuration is basically the same as that shown in FIG. 1. The travel motor may be used as the motor for starting up the engine E, and the application of the vehicle control device of the present invention is also possible.

Figure 8:
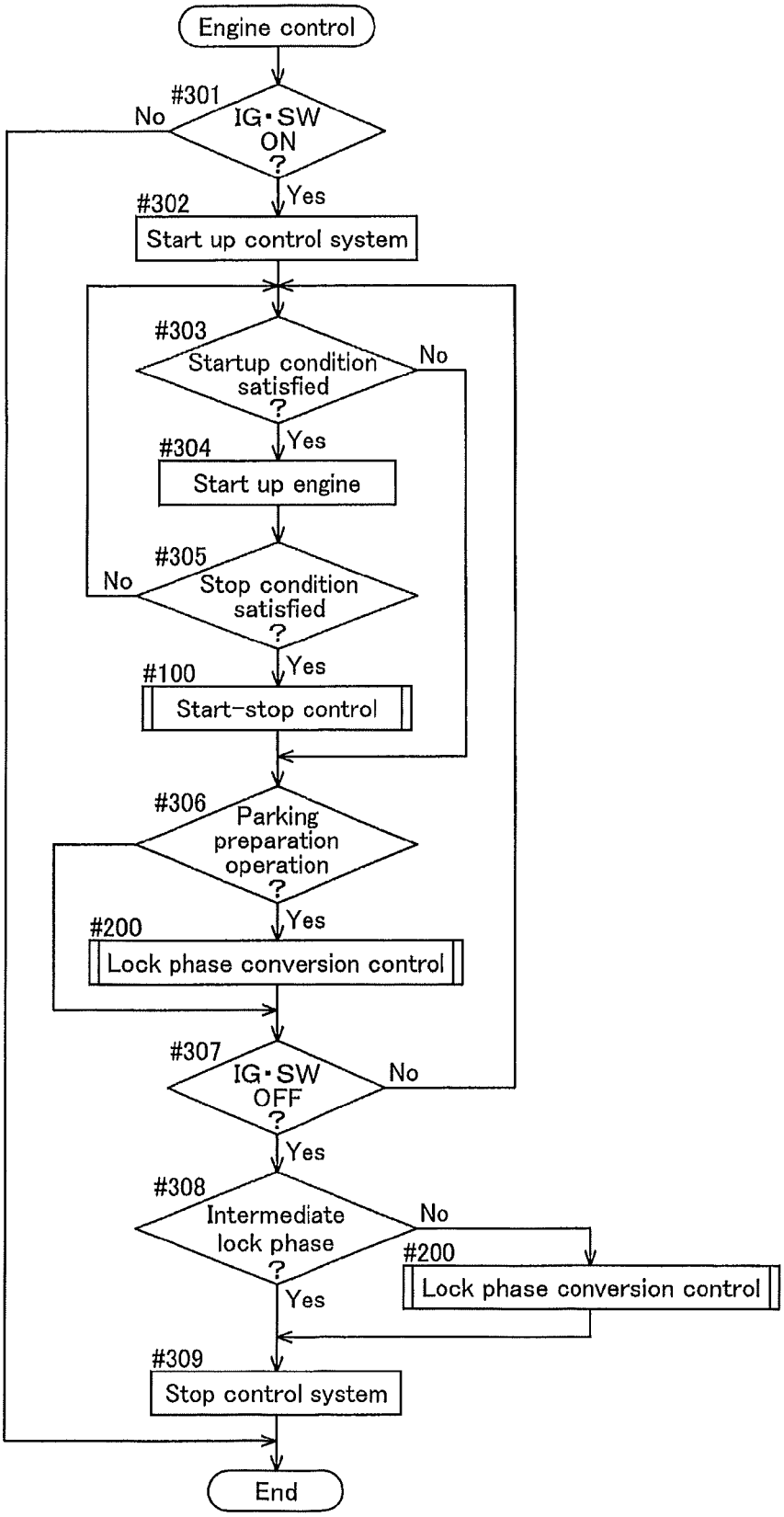
FIG. 8 is a flowchart of engine control in an alternative embodiment (b).

(b) The present invention is applied to performing start-stop control (one example of stop control) in the case where a condition for stopping the engine E is established in a hybrid vehicle having the configuration of alternative embodiment (a) described above. This start-stop control is not linked with the pressing of the brake pedal, but rather engine E stopping and startup are performed based on predetermined conditions, and this control mode is shown in the flowchart in FIG. 8. Note that as a condition for stopping the engine E, the case where the voltage of the battery increases to a predetermined value due to charging is envisioned, and as a condition for starting up the engine E, the case where the voltage of the battery decreasing to a value below the predetermined value is conceivable.

In this engine control, the system is started up due to the ignition switch 43 being switched on, the engine E is started up if an engine startup condition is satisfied, and the engine E is stopped due to start-stop control if an engine stop condition is satisfied (steps #301 to #305, step #100).

Also, in this control as well, if a parking preparation operation is performed, lock phase conversion control is performed (step #306, #200). Also, if the ignition switch 43 is switched off in a situation in which the engine E is stopped due to start-stop control, lock phase conversion control is executed, and then the control system is stopped (steps #307, #308, #200, #309), or control is performed to directly stop the control system (step #309).

Engine control in this alternative embodiment (b) is directed to a hybrid vehicle, but the setting of the relative rotation phase to the intermediate lock phase P2 in start-stop control (step #100) is the same as that in the start-stop control in the embodiment described above. Also, if a parking preparation operation is performed in a situation in which the engine E is stopped due to start-stop control, lock phase conversion control (step #200) is executed similarly to the embodiment. This achieves actions and effects similar to the actions and effects of the previously described embodiment.

Figure 9:
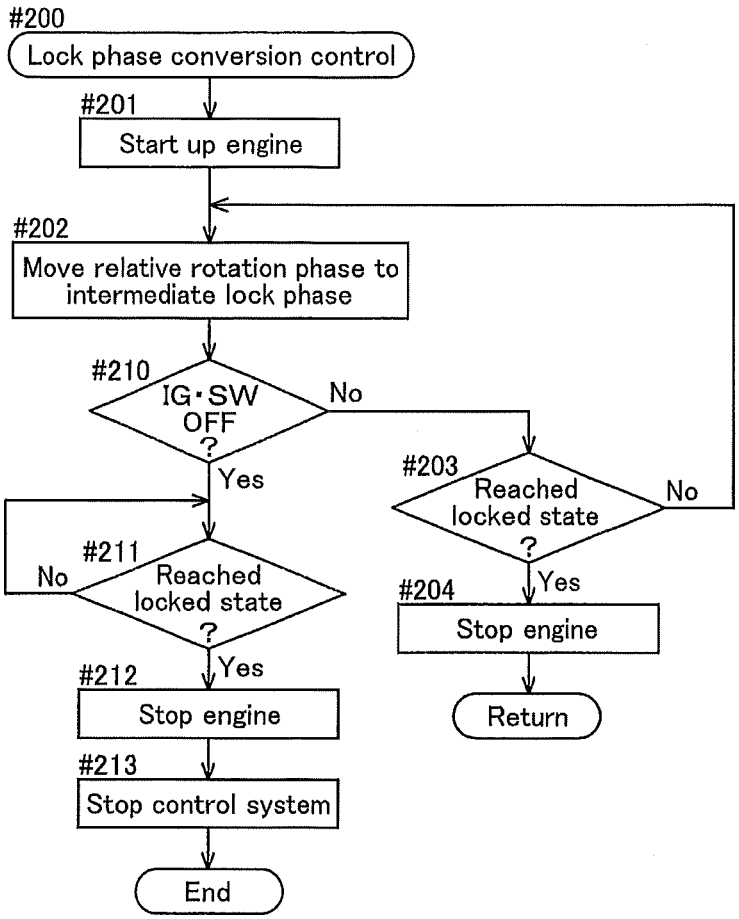
FIG. 9 is a flowchart of lock phase conversion control in an alternative embodiment (c).

(c) The control shown in the flowchart in FIG. 9 is performed as control of the lock phase conversion control (step #200). This control is directed to any of the configuration of the embodiment and the configuration of a hybrid vehicle. The engine E is started up by driving of the starter motor M, and the relative rotation phase is moved in the advance direction Sa by operating the phase control valve 21 to the advance position (steps #201 and #202).

Also, if it is confirmed by a detection signal from the phase detection sensor 46 that the relative rotation phase reached the intermediate lock phase P2 (if it is confirmed that the lock mechanisms L have reached the locked state) without the ignition switch 43 being switched off at the time of movement of the relative rotation phase, the engine E is stopped, and the process returns (steps #210, #203, #204). In contrast, if the ignition switch 43 is switched off (if a stop operation is performed on the engine E) at the time of movement of the relative rotation phase (before the intermediate lock phase P2 is reached), it is confirmed by a detection signal from the phase detection sensor 46 that the intermediate lock phase P2 has been reached, and thereafter the engine E is stopped, and the control system is stopped (steps #210 to #213).

In this alternative embodiment (c), if the ignition switch 43 is switched off before the relative rotation phase reaches the intermediate lock phase P2, the engine E is stopped, and then stopping of the control system is realized. Stopping the control system in this way reduces the wasteful consumption of power. In particular, since it is confirmed that the lock mechanisms L have reached the locked state using a detection signal from the phase detection sensor 46, shifting to the locked state is also reliably performed.

Figure 10:
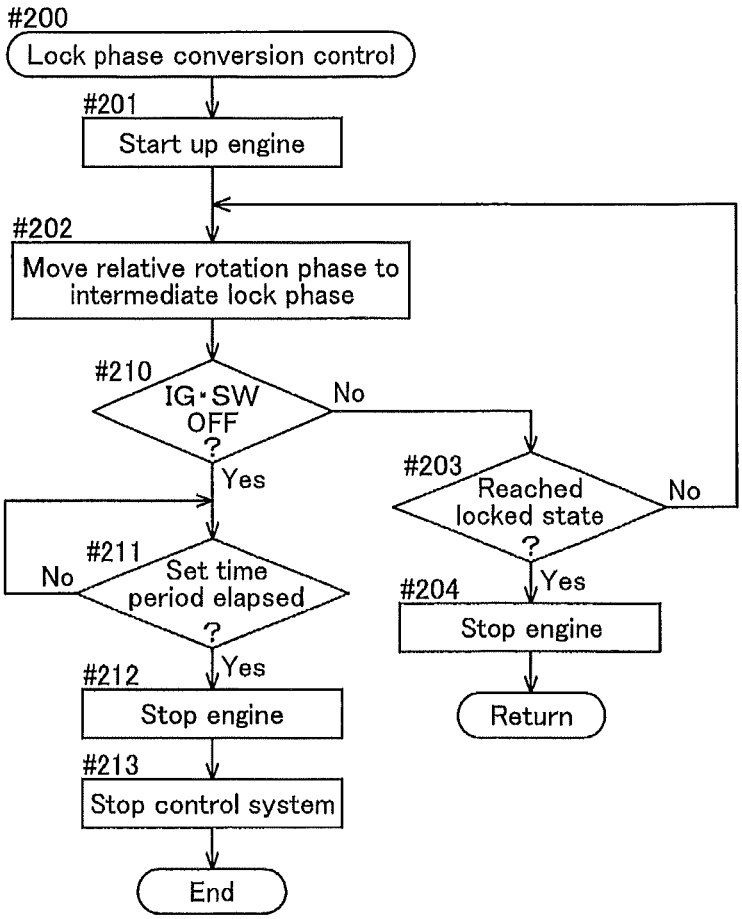
FIG. 10 is a flowchart of lock phase conversion control in an alternative embodiment (d).

(d) The control shown in the flowchart in FIG. 10 is performed as control of the lock phase conversion control (step #200). The control in this alternative embodiment (d) is basically the control in alternative embodiment (c), but is different in that, as the control in step #211, if the relative rotation phase is moved toward the intermediate lock phase P2, this movement is performed until a set time period has elapsed.

In this alternative embodiment (d), actions and effects similar to alternative embodiment (c) are achieved, and since movement toward the intermediate lock phase P2 continues until a set time period has elapsed in step #211, the relative rotation phase is reliably shifted to the intermediate lock phase P2 without performing control for feeding back the detection signal of the phase detection sensor 46.

INDUSTRIAL APPLICABILITY

The present invention can be used in a vehicle control device in which start-stopping of the internal combustion engine is performed.

REFERENCE SIGNS LIST

1: crankshaft
3: camshaft, intake camshaft
10: valve opening/closing timing control mechanism
11: driving rotating body (external rotor)
12: driven rotating body (internal rotor)
40: control unit
E: internal combustion engine (engine)
L: lock mechanism
M: motor
T: transmission mechanism
V: control valve mechanism Ca: advancing chamber
Cb: retarding chamber
P1: first lock phase, maximum retard lock phase
P2: second lock phase, intermediate lock phase

The invention claimed is:

1. A vehicle control device comprising:

an internal combustion engine provided in a vehicle;

a transmission mechanism that changes drive force from the internal combustion engine and transmits the changed drive force to a travel drive system;

an electric motor that starts up the internal combustion engine;

a valve opening/closing timing control mechanism having a driving rotating body that rotates synchronously with a crankshaft of the internal combustion engine and a driven rotating body that is arranged on the same axis as the driving rotating body and rotates integrally with a valve opening/closing camshaft of the internal combustion engine, and having a lock mechanism that selectively holds a relative rotation phase of the driving rotating body and the driven rotating body at a first lock phase and a second lock phase that is different from the first lock phase;

a control valve mechanism that controls the relative rotation phase in accordance with supply/discharge of a fluid to/from an advancing chamber and a retarding chamber formed between the driving rotating body and the driven rotating body, and that selectively performs holding and canceling of a locked state in accordance with supply/discharge of fluid to/from the lock mechanism; and a control unit that, in a case where the vehicle is stopped in a state where the transmission mechanism is set to a first shift position in which the vehicle can travel, performs stop control to hold the lock mechanism at the first lock phase and stop the internal combustion engine, and, in a case where the transmission mechanism is switched to the second shift position that is different from the first shift position in a situation where the internal combustion engine is stopped based on the stop control, controls the motor to start up the internal combustion engine and executes phase conversion control in which the lock mechanism shifts from the first lock phase to the second lock phase.

2. The vehicle control device according to claim 1, wherein the valve opening/closing timing control mechanism is provided on an intake camshaft that serves as the camshaft, the first lock phase is set at a maximum retard phase at which an intake valve opening/closing timing is most delayed, and the second lock phase is set to an intermediate lock phase at which the intake valve opening/closing timing is earlier than the maximum retard phase.

3. The vehicle control device according to claim 1, wherein in a case where a stop operation is performed on the internal combustion engine in a process of shifting from the first lock phase to the second lock phase based on the phase conversion control, the internal combustion engine is stopped after the control unit confirms completion of the shift to the second lock phase.

4. The vehicle control device according to claim 1, wherein in a case where the transmission mechanism is operated such that the internal combustion engine is to stop in a process of shifting from the first lock phase to the second lock phase based on the phase conversion control, the internal combustion engine is stopped after a set time has elapsed from when the operation was performed.

5. The vehicle control device according to claim 1, wherein control in which the internal combustion engine is started up based on the phase conversion control continues until a shift to a state in which the crankshaft starts to rotate due to combustion of fuel supplied to the internal combustion engine.

6. The vehicle control device according to claim 1, wherein the motor is a motor for traveling.

* * * * *